United States Patent [19]

Simon

[11] Patent Number: 5,060,709

[45] Date of Patent: Oct. 29, 1991

[54] INFINITELY SIZABLE SOLID SLAT MINI BLIND

[75] Inventor: Terry L. Simon, Rockford, Ill.

[73] Assignee: Newell Co., Freeport, Ill.

[21] Appl. No.: 419,320

[22] Filed: Oct. 10, 1989

[51] Int. Cl.[5] ..... E06B 9/30

[52] U.S. Cl. ..... 160/168.1; 160/176.1

[58] Field of Search ..... 160/168.1, 176.1, 171, 160/178.2, 178.3

[56] References Cited

U.S. PATENT DOCUMENTS

| | | | |
|---|---|---|---|
| 2,231,778 | 2/1941 | Swanson | 160/176.1 X |
| 2,297,627 | 9/1942 | Loehr | 160/176.1 X |
| 2,307,278 | 1/1943 | Krantz | 160/176.1 X |
| 2,397,765 | 4/1946 | Sylvanus | 160/176.1 X |
| 3,389,737 | 6/1968 | Arnold et al. | 160/168.1 |
| 4,177,853 | 12/1979 | Anderson et al. | 160/168.1 |
| 4,727,921 | 3/1988 | Vecchiarelli | 160/168.1 |
| 4,945,970 | 8/1990 | Marocco | 160/178.2 |

*Primary Examiner*—Blair M. Johnson

*Attorney, Agent, or Firm*—Baker & McKenzie

[57] ABSTRACT

The invention is embodied in a mini-blind which has a headrail and an array of slats suspended therefrom. The slats are raised, lowered and adjusted with a plurality of cords. The slats are generally free from apertures which extend through the slats. The cords used to lift the array of slats run along the outer edges of the slats. At least one of the ladder cords, which are used to adjust the angular orientation of the slats, engages notches formed in the edges of the slats. The invention also has a unique method of controlling the lifting cords as they extend through and out of the headrail. A basket/barrel assembly having a bent wire cord guide cooperates with cord locking and tilting mechanisms which are housed together at one end of the headrail.

10 Claims, 3 Drawing Sheets

Fig. 2.
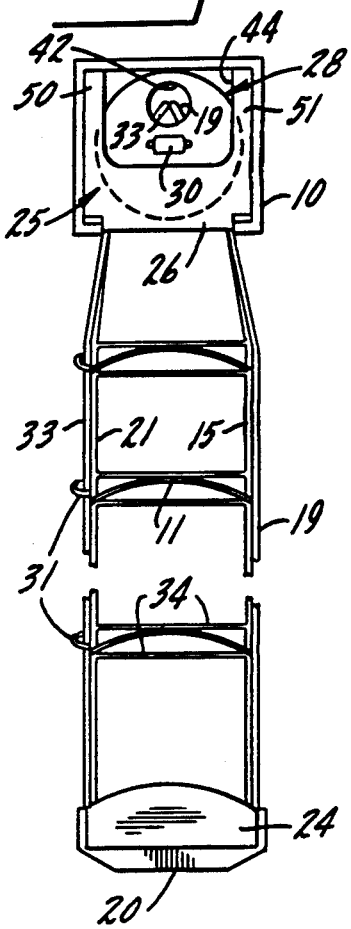
Fig. 5.
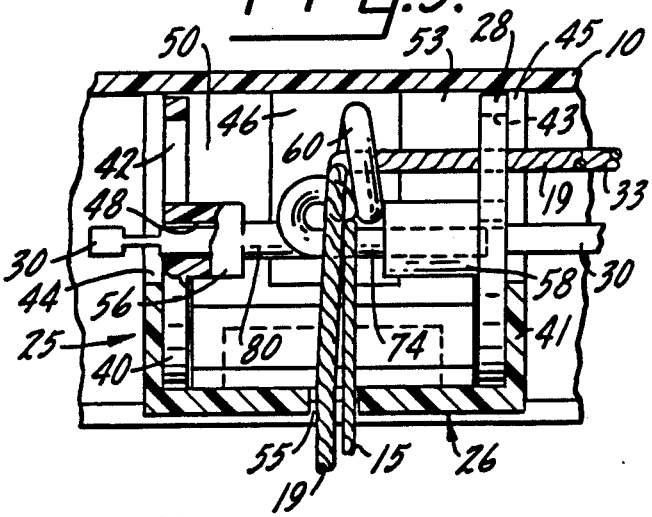
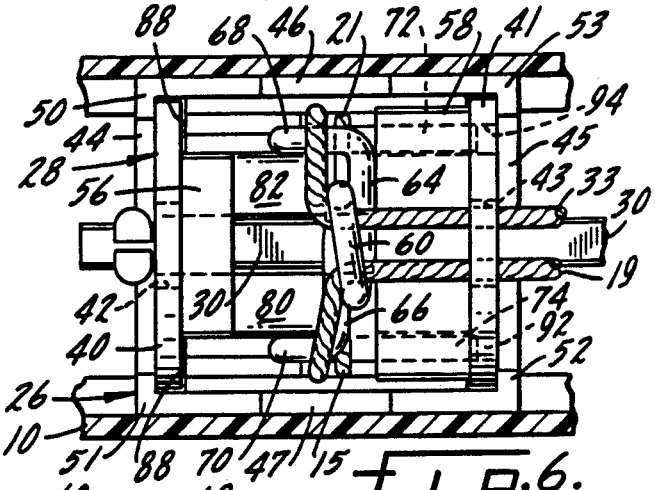
Fig. 6.
Fig. 3.
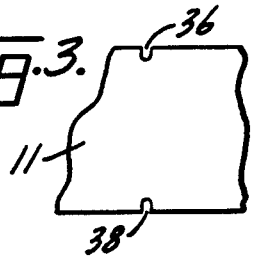
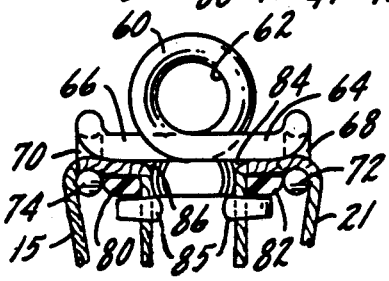
Fig. 7.
Fig. 4.
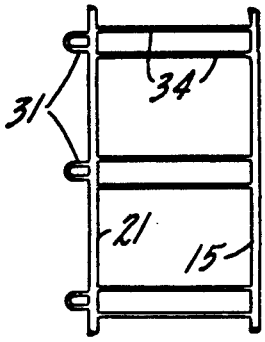
Fig. 8.
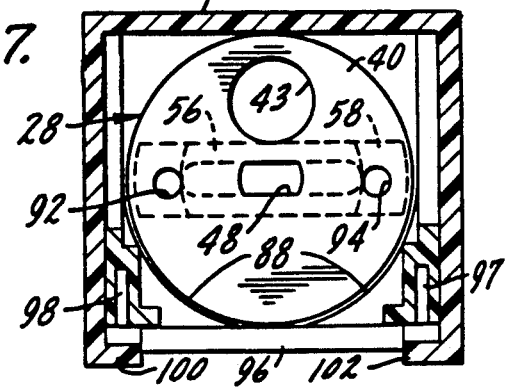

INFINITELY SIZABLE SOLID SLAT MINI BLIND

BACKGROUND AND SUMMARY OF THE INVENTION

The present invention relates to window coverings, and more specifically to blinds which are used to control the amount of light coming through a window. Such blinds are available in various widths. However, a very popular size is one called a mini-blind which has slats which are approximately 1 inch in width. The invention as described herein has been applied to a mini-blind. However, the concepts discussed herein are applicable to other kinds of blinds.

Most blinds which are currently available lifting cords which are used to raise and lower the blind to desired levels, depending upon the amount of light which is to be admitted. The raising and lowering of the blind is achieved by attachment of the lifting cords to a bottom rail so that the slats stack upon one another as the bottom rail is raised. Similarly, as the bottom rail is lowered, the slats are separated by a ladder cord. Typically, each of the slats of the blind has a plurality of openings, one opening for each lifting cord. The openings are generally centrally disposed so that a single lifting cord will extend through the openings of several slats to the bottom rail. A typical arrangement is shown in U.S. Pat. No. 4,567,930, assigned to the assignee of the present invention.

One of the drawbacks of providing a single lifting cord at a particular lifting location is the inability to completely block light that passes through a window. This difficulty arises from the fact that the centrally disposed lifting cord interferes with slat-to-slat contact which would create a "room darkening" blind. While the interference is relatively minor, because small diameter cords are generally used, the cumulative effect of the series of thin horizontal openings between slats created by the interference of the lifting cord makes a significant difference in efforts to create a room darkening blind.

Therefore, it is an object of the present invention to provide a blind which substantially improves the blockage of light therethrough.

It is another object of the invention to provide a blind with slats which do not have holes drilled therethrough.

A further object of the invention is to provide a blind in which the slats thereof may be raised, lowered and adjusted angularly with ease and efficiency.

Yet another object of the invention is to provide a mini-blind in which the slats can be easily replaced without completely disassembling the blind.

Still another object of the invention is to provide a blind in which the complexity and number of parts used to achieve various adjustments of the blind are minimized.

These and other objects of the invention are achieved with a blind in which a plurality of slats are suspended from a headrail to form a vertically disposed array. Raising and lowering of the slats is achieved with a plurality of lifting cords, two cords for each lifting location. The lifting cords for each location extend along the outer edge of the array and, with respect to at least one lifting location, the slats have notches in which the vertical portions of a ladder cord ride. The engagement between the notches and the ladder cords prevent lateral movement of the slats out of alignment. The blind of the present invention also has a unique arrangement of components which are used to actuate raising and lowering, as well as angular adjustment of the slats.

BRIEF DESCRIPTION OF THE DRAWINGS

The objects and advantages of the invention will be more clearly understood after reading the following specification, read in conjunction with the accompanying drawings where:

FIG. 2 is a left end view of the blind of FIG. 1;

FIG. 3 is an enlarged plan view of a portion of a slat of the present invention showing notches in the longitudinal edges of a slat;

FIG. 4 is an elevational view of a ladder cord arrangement of the present invention;

FIG. 5 is a side elevational view in partial section showing the basket-and-barrel assembly of the present assembly;

FIG. 6 is a top plan view of the basket-and-barrel assembly shown in FIG. 5;

FIG. 7 is a sectional view showing the means by which the ladder cords are controlled in accordance with the present invention;

FIG. 8 is a sectional view of the basket-and-barrel assembly of the present invention, without showing lifting cords or a tilter rod;

DETAILED DESCRIPTION OF THE INVENTION

The figures depict a single embodiment of the invention in which the same reference numbers are used to refer to the same parts throughout the various figures.

Figure 1:
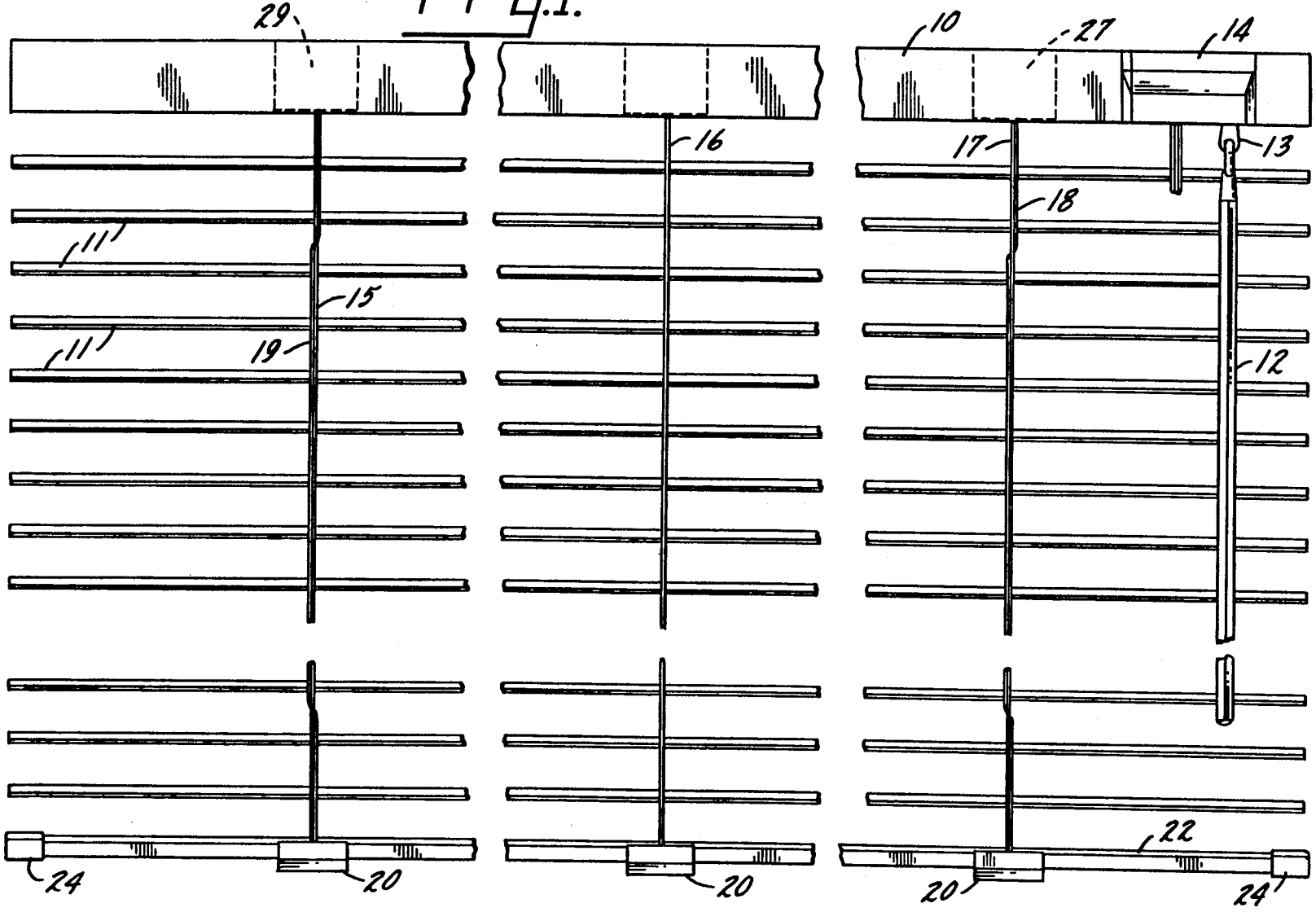
FIG. 1 is an overall elevational view of a blind of the present invention.

FIG. 1 shows a mini-blind made in accordance with the present invention. The headrail 10 supports an array of slats 11. The slats 11 are supported by a group of three ladder cords 15, 16 and 17. The ladder cords are used to vary the angular orientation of the slats. The angular orientation is varied by operation of the wand 12 which turns the tilter shaft 13. Rotative forces applied to the tilter shaft 13 are transferred through the tilter mechanism (not shown in FIG. 1 but shown in detail in FIGS. 12 and 13) to a tilter bar, which is perpendicular to the tilter shaft 13. Rotation of the tilter bar causes angular adjustment of the slats 11. The tilter mechanism is housed in the combined tilter/cord lock housing 14 at the right hand end of the headrail 10.

Figure 10:
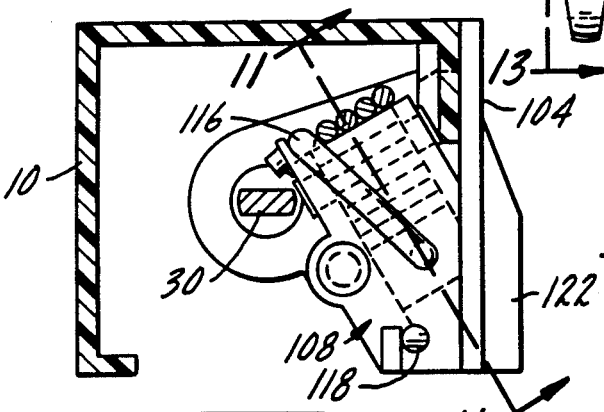
FIG. 10 is a sectional view taken along line 10—10 of FIG. 9.
Figure 11:
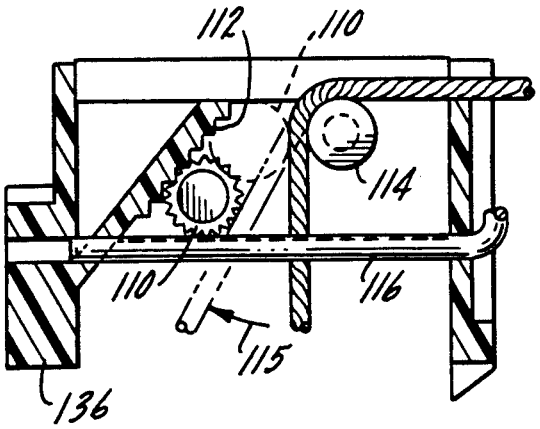
FIG. 11 is a sectional view taken along line 11—11 of FIG. 10.

Also housed in the combined tilter/cord lock housing is a cord lock mechanism (not shown in FIG. 1 but shown in detail in FIGS. 10 and 11). FIG. 1 shows front lifting cords 18 and 19 which extend through the housing 14 along the headrail to the lift locations 27 and 29. For each front lift cord 18 and 19 there is a corresponding rear lift cord 32 and 33 (not shown in FIG. 1, but shown in FIGS. 2 and 6). The lift cords 18, 19, 32 and 33 are connected to the bottom rail 22, to which are attached clips 20 and end caps 24. The lift cords for any given lifting location may be parts of a single continuous cord which wraps around the bottom rail and is held from slipping by a clip 20, the former being the preferred arrangement; or, they may be separate individual cords, each of which is fixed to the bottom rail by a clip 20.

FIG. 2 is an end view of the blind shown in FIG. 1. This end view shows the basket/barrel assembly 25 contained within the headrail 10. The slats 11 are held by rung cords 34 which are connected to the front vertical ladder cord 15 and the rear vertical ladder cord 21. The rear lift cord 33 is threaded through loops 31 (see FIG. 4) which are attached to the rear ladder cord 21 at the elevations of the rungs 34. The positive engagement between the ladder cords and the lift cords provided by the loops 31 ensures the alignment of the ladders with the lift cords. It should be noted that in FIG. 1 the front lift cords 18 and 19 are simply woven into engagement with the corresponding front lift cord, at approximately every tenth to fifteenth slat. It should also be noted that a vertical rear ladder cord (not shown) corresponding to the front vertical ladder cord 17 would also be equipped with loops to guide the rear lift cord at the lift location 27.

FIG. 2 also provides an end view of the components of the combined basket/barrel assembly 25. Those components include the basket 26 with upstanding legs 50 and 51, see FIG. 5, and the barrel 28 with cord opening 42. Also shown is the end of the tilter rod 30, which has been partially flattened to prevent its passage through the tilter bar opening 48. The front and rear lift cords, 19 and 33, can be seen through the opening 42. It should be noted that an end view of the barrel located at the lift location 27 would show two lift cords extending downwardly and two additional lift cords extending through the opening 42.

FIG. 3 shows notches 36 and 38 formed in each of the slats 11. The notches are intended to provide lateral stability to the slats by virtue of their engagement with the vertical lift cords. It is only necessary that engagement between the slats and the lift cords be provided at a single ladder location on each slat, although plural sets of notches can be provided on each of the slats to further prevent lateral movement of a ladder relative to the slats.

FIGS. 5, 6, 7 and 8 show the structural details of the basket 26 and the barrel 28. The basket 26 is a generally cup shaped member with four upstanding legs 50, 51, 52 and 53, which are created by the U-shaped openings 44, 45, 46 and 47. The U-shaped openings 44 and 45 allow passage of both lifting cords and the tilter bar 30 through the basket 26. The basket 26 has a cradle-like configuration due to the cylindrical barrel tracks 88 which provide a bearing surface for the end flanges 40 and 41 of the barrel. The barrel tracks 88 allow for pivoting of the barrel within the basket 26 about the tilter rod 30. The generally rectangular shape of the tilter bar 30 and the close fitting relationship of the bar to the opening 48 results in the transfer of rotational movement of the bar to the barrel.

The guide wire 60 is carried by the larger block 58 which is integral with the flange 41. A smaller block 56 is integrally formed with the flange 40. Linking struts 80 and 82 connect the blocks 56 and 58 and extend between the blocks on each side of the tilter rod 30 and the rod opening 48. The guide wire 60 has a main helical opening 62 through which the lifting cords 19 and 33 extend. The guide wire 60 includes lateral legs 64 and 66, to which are connected elbows 68 and 70. Supporting arms 72 and 74 extend from the elbows 68 and 70. The supporting arms 72 and 74 extend into holes 92 and 94 formed in the block 58 of the barrel. The lifting cords 19 and 33 are held in laterally spread positions by the elbows 68 and 70 and by the arms 72 and 74. The lifting cords extend down through the slot 55 formed in the bottom of the basket 26. The lifting cords 19 and 33 extend along the outside edges of the slats 11.

Similarly, as shown in FIG. 7, the vertical ladder cords 15 and 21 are held in a laterally spread position by the arms 72 and 74. Notches 84 and 86 are formed in the linking struts 80 and 82 to hold the vertical ladder cords 15 and 21 in place. Deformable metal clips 85 are used at the terminal ends of the vertical ladder cords 15 and 21 to prevent them from slipping through the notches 84 and 86.

FIG. 8 shows an end view of the barrel 28 (with the cords omitted for clarity). Also shown in FIG. 8 are the slots 97 and 98 which receive clips (not shown) which engage the upward surfaces of the inwardly extending edges 100 and 102 of the headrail 10. Free ends of the clips fix the basket at a particular location once the downward force of the lifting rods is applied to the barrel/basket assembly. The lower guide block 96 on the bottom of the basket guides the basket between the inward edges 100 and 102 as the basket slides into the correct position along the headrail 10.

It should be noted that an important aspect of the invention is the fact that the lifting cords and the vertical ladder cords are spread from the axis of rotation of the barrel an equal amount. This arrangement allows the tilter rod to be operated without creating differential movement between the lifting cord and the vertical ladder cord. In order to achieve the desired lateral spreading of the cords, it is necessary to pass the lifting cords through the barrel at a position above the axis of the barrel. Therefore, the arrangement of the helical opening 62 and the cord passageways 42 and 43 are important. Also important is the placement of the cord lock assembly (discussed below) so that the cords are presented in such a manner that they can extend through the above-center cord passageways and the main openings of the wire guides in each basket/barrel assembly.

Figure 9:
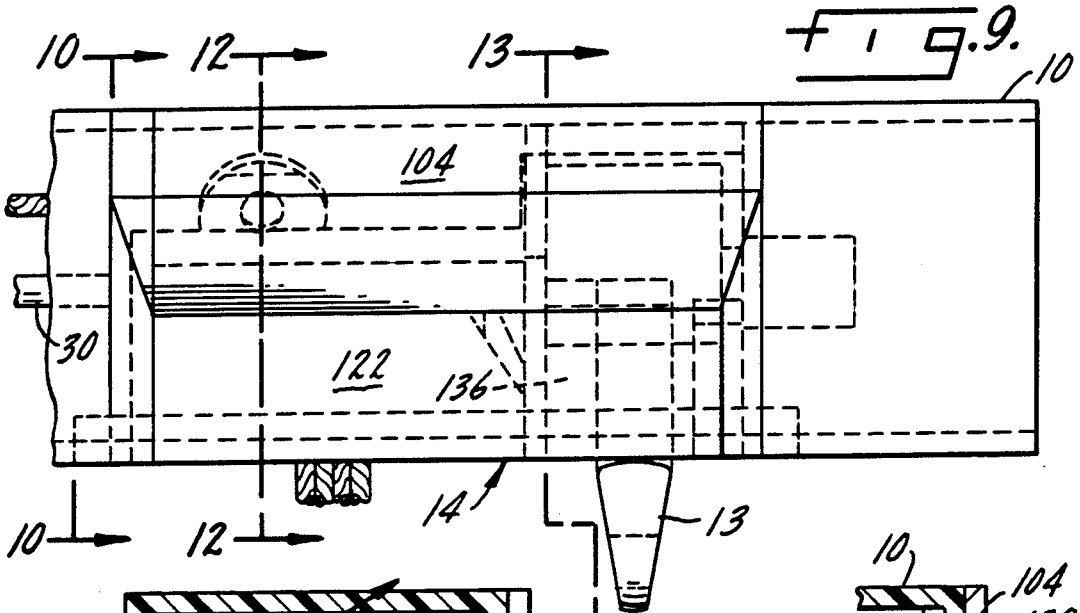
FIG. 9 is a front elevational view of the combined cord locking and tilter mechanisms of the present invention.

FIGS. 9 through 13 show in detail the combined tilter/cord lock housing and the tilter and cord lock mechanisms. FIG. 9 is a front elevational view of the headrail 10 with the tilter/cord lock housing 14 installed therein. The front wall 104 of the cord lock mechanism includes a protruding section 122. The front wall 104 covers an opening (not shown) in the front surface of the headrail 10.

Figure 12:
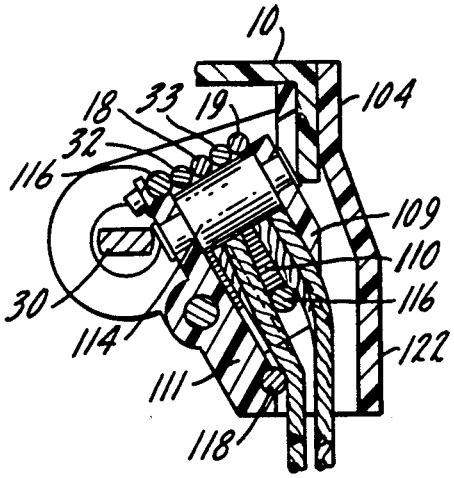
FIG. 12 is a sectional view taken along line 12—12 of FIG. 9.

The cord locking mechanism 108 is most clearly shown in FIGS. 10, 11 and 12. The cord locking mechanism includes a toothed roller 110 which selectively engages a toothed incline 112 when the lifting cords are brought into contact with the toothed roller 110. The dotted position of the lifting cords in FIG. 11 shows how the lateral movement of the lifting cord causes the toothed roller to engage the toothed incline 112. The arrow 115 shows the lateral movement of the lifting cord. As the lifting cord is moved in the direction of the arrow 115, the toothed roller will ascend the toothed incline 112. When the toothed roller reaches the upper position 110, the cord will be wedged between the toothed roller and the bearing cylinder 114.

The toothed roller 110 is held in position by the separator bar 116 and by the front wall portion 109 and rear wall portion 111. The separator bar 116 also operates to divide the lifting cords associated with a particular lifting location from the cords of another lifting location, in order to prevent entanglement thereof. Similarly, the separator bar 116 ensures that the lifting cords 33 and 19 approach the toothed roller and the bearing cylinder at an angle which is approximately perpendicular to the axes of the roller 110 and the cylinder 114. Similarly, the guide bar 118 presents the other set of lifting cords 32 and 18 in a similarly perpendicular fashion.

Figure 13:
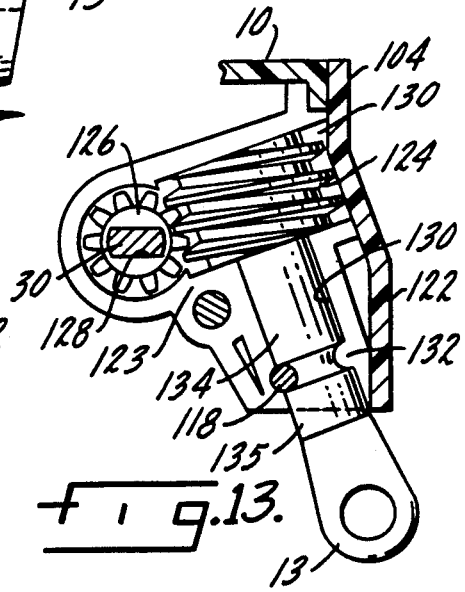
FIG. 13 is a sectional view taken along line 13—13 of FIG. 9.

The tilter mechanism is most clearly shown in FIG. 13. The tilter shaft 13 includes a straight section 134 and a neck 132. The double lead worm gear 124 is disposed at one end of the tilter shaft. The pinion 126 has a rectangular opening 128, which receives the rectangular tilter rod 30. The tilter shaft, worm gear and pinion fit into an L-shaped pocket 130 in the tilter mechanism housing 123. Because the worm gear is larger in diameter than the tilter shaft 13, the portion of pocket 130 above the shaft 13 is able to receive the block 136 on the tilter mechanism (see FIG. 11). The engagement of the block 136 in the pocket 130 enables the tilter mechanism housing 123 to support the cord locking mechanism 108. It should be noted that the block 136 has grooves (not shown) which correspond to the rib 132 and the guide bar 118, in order to further stabilize the engagement between the tilter mechanism and the cord locking mechanism.

Blinds arranged in accordance with the present invention are designed so that adjacent slats can come into contact with one another along substantially their entire length. This arrangement provides superior light blockage as compared to blinds which have a center lifting cord which interferes with and prevents adjacent slat contact. Another benefit of the present invention is that the contact between adjacent slats enables the blind to be designed with fewer slats, and larger spaces between slats. Because fewer slats are used, the blind is less costly. Also, because there is increased spacing between slats, more light can shine through the blind when desired. Thus, the blind of the present invention has a greater range of adjustment both in closing and opening.

While the invention has been shown and described with respect to a single embodiment, it is anticipated that numerous alternatives, modifications and variations will occur to those who understand the invention. It is intended that all such alternatives, modifications and variations be included within the spirit and scope of the appended claims.

I claim:

1. A blind comprising a plurality of slats suspended in a vertical array from a main supporting member, said blind including array control means for varying said array, said array control means including tilting means for changing the angular orientation of said slats, and lifting means for changing the extent to which said slats extend from said supporting member, said lifting means including cord means extending along the outer periphery of said slats, said slats being generally free of apertures extending through said slats, whereby said slats are able to contact one another without interference from said cord means, said array control means including a rotatable drum, said drum carrying guiding means for directing said lifting means from a generally horizontal transverse position to a generally vertical position, and for cooperating with said drum to hold said tilting means, said guiding means and said drum having aligned apertures for receiving said lifting means.

2. A blind comprising a plurality of slats suspended in a vertical array from a main supporting member, said blind including array control means for varying said array, said array control means including tilting means for changing the angular orientation of said slats, and lifting means for changing the extent to which said slats extend from said supporting member, said lifting means including cord means extending along the outer periphery of said slats, said slats being generally free of apertures extending through said slats, whereby said slats are able to contact one another without interference from said cord means.

said array control means including a rotatable drum, said drum carrying guiding means for directing said lifting means from a generally horizontal transverse position to a generally vertical position, and for cooperating with said rum to hold said tilting means, said guiding means having a central aperture defining a generally vertical plane, and a pair of arms extending perpendicular to said plane, said arms extending through said plane.

3. A blind in accordance with claim 2 wherein:

said guiding means includes a single bent wire, said aperture being formed from a helical section of said wire, said arms extending from tangential linking sections of said wire, said linking sections extending outwardly from one side of said helical section.

4. A blind in accordance with claim 1 wherein:

said drum includes slot means for holding terminal portions of a ladder used to support said slats.

5. A blind comprising a plurality of slats suspended in a vertical array from a main supporting member, said blind including array control means for varying said array, said array control means including tilting means for changing the angular orientation of said slats, and lifting means for changing the extent to which said slats extend from said supporting member, said lifting means including cord means extending along the outer periphery of said slats, said slats being generally free of apertures extending through said slats, whereby said slats are able to contact one another without interference from said cord means, said array control means including a rotatable drum, said drum carrying guiding means for directing said lifting means from a generally horizontal transverse position to a generally vertical position, and for cooperating with said drum to hold said tilting means, said array control means comprising a basket for holding said drum, said basket including a slot formed in its bottom surface, and a pair of arcuate tracks for engaging end flanges of said drum.

6. A blind comprising a plurality of slats suspended in a vertical array from a main supporting member, lifting cord means for raising and lowering said slats, said blind including array control means which includes a basket and a barrel supported by said basket, said barrel having a pair of end flanges separated by integrally formed linking struts, said end flanges having openings forming cord passageways through which said cord means pass, said basket having tracks for engaging and supporting said end flanges in a manner which allows rotation of said barrel without substantial translation thereof.

7. A blind in accordance with claim 6 wherein:

said array control means includes a cord guide held by said barrel, said cord guide having a central opening and cord support legs spaced substantially away from the axis of rotation of said barrel.

8. A blind comprising a plurality of slats suspended in a vertical array from a main supporting member, said blind including array control means for varying said array, said array control means including tilting means for changing the angular orientation of said slats, and lifting means for changing the extent to which said slats extend from said supporting member, said lifting means including cord means extending along the outer periphery of said slats, said slats being generally free of apertures extending through said slats, whereby said slats are able to contact one another without interference from said cord means, said array control means further including a rotatable drum, said drum having means for simultaneously moving said lifting means and said tilting means.

9. A blind in accordance with claim 8 wherein:

said blind includes a tilter mechanism and a cord locking mechanism, said mechanisms being engaged with one another in a single housing.

10. A blind comprising a plurality of slats suspended in a vertical array from a main supporting member, said blind including array control means for varying said array, said array control means including tilting means for changing the angular orientation of said slats, and lifting means for changing the extent to which said slats extend from said supporting member, said lifting means including cord means extending along the outer periphery of said slats, said slats being generally free of apertures extending through said slats, whereby said slats are able to contact one another without interference from said cord means, said array control means including a rotatable drum, said drum carrying guiding means for directing said lifting means from a generally horizontal transverse position to a generally vertical position, and for cooperating with said drum to hold said tilting means.

* * * * *